United States Patent [19]

Blair

[11] 4,253,433

[45] Mar. 3, 1981

[54] STRATIFIED-CHARGE TWO-STROKE INTERNAL COMBUSTION ENGINES

[75] Inventor: Gordon P. Blair, Belfast, Northern Ireland

[73] Assignee: The Queens University of Belfast, Belfast, Northern Ireland

[21] Appl. No.: 38,052

[22] Filed: May 11, 1979

[30] Foreign Application Priority Data

May 12, 1978 [GB] United Kingdom ..... 19128/78

[51] Int. Cl.[3] ..... F24B 13/04

[52] U.S. Cl. ..... 123/73 R; 123/73 A; 123/73 B; 123/DIG. 4

[58] Field of Search ..... 123/DIG. 4, 32 ST, 75 B, 123/73 A, 73 B, 73 R

[56] References Cited

U.S. PATENT DOCUMENTS

| | | | |
|---|---|---|---|
| 1,121,584 | 12/1914 | Harper, Jr. | 123/73 B |
| 1,296,214 | 3/1919 | Petler | 123/73 B |
| 3,916,851 | 11/1975 | Otani | 123/DIG. 4 |

FOREIGN PATENT DOCUMENTS

| | | | |
|---|---|---|---|
| 2650834 | 6/1977 | Fed. Rep. of Germany | 123/DIG. 4 |

*Primary Examiner*—Wendell E. Burns

*Attorney, Agent, or Firm*—Fleit & Jacobson

[57] ABSTRACT

In a crankcase scavenged two-stroke internal combustion engine, a duct and at least one further passage extends between the crankcase chamber and the combustion chamber. There is a fuel/air mixture port leading into the duct and a pure air port leading into the duct or the crankcase chamber. The passage exits into the combustion chamber between the exit into that chamber from the duct and an exhaust port leading out of the combustion chamber. In operation fuel enters the combustion chamber in the air of the fuel/air stream entering the duct and air is additionally pushed into the combustion chamber by the downward movement of the piston through the passage and the duct. The fuel is separated from the exhaust port by a layer of air leading to better fuel consumption and higher oxidation combustion products.

9 Claims, 8 Drawing Figures

STRATIFIED-CHARGE TWO-STROKE INTERNAL COMBUSTION ENGINES

This invention relates to internal combustion engines.

In two-stroke internal combustion engines commonly used to power motorcycles, mopeds, outboard marine engines, chainsaws, drone aircraft engines and in many other applications the power unit is of the crankcase compression type and, using either the loop or the cross-scavenging method, the combustion of the fuel and air mixture is initiated by an electric spark discharge. The fuel used is commonly a liquid and of the hydrocarbon type.

According to this invention a two-stroke internal combustion engine comprises a combustion chamber, a piston reciprocable in the combustion chamber, an exhaust port from the combustion chamber, a crankcase chamber, a duct extending between the crankcase chamber and the combustion chamber, an admission port to the duct, the duct communicating with the combustion chamber at a point remote from the exhaust port, a further admission port to the crankcase chamber of the engine and a further passage between the combustion chamber and the crankcase chamber, communication between the combustion chamber and the crankcase chamber through the duct and the passage being controlled by movement of the piston.

There could be two or more said ducts each with an admission port. There could be two or more exhaust ports. There could be two or more admission ports to the crankcase chamber.

The admission port to the crankcase chamber is intended for admission of air and the admission port to the duct is intended for admission of air and fuel.

Lubricant for the crankcase could be admitted through the admission port to the crankcase chamber.

The invention may be performed in various ways and one specific embodiment with possible modifications will now be described by way of example with reference to the accompanying drawings, in which.

Figure 3B:
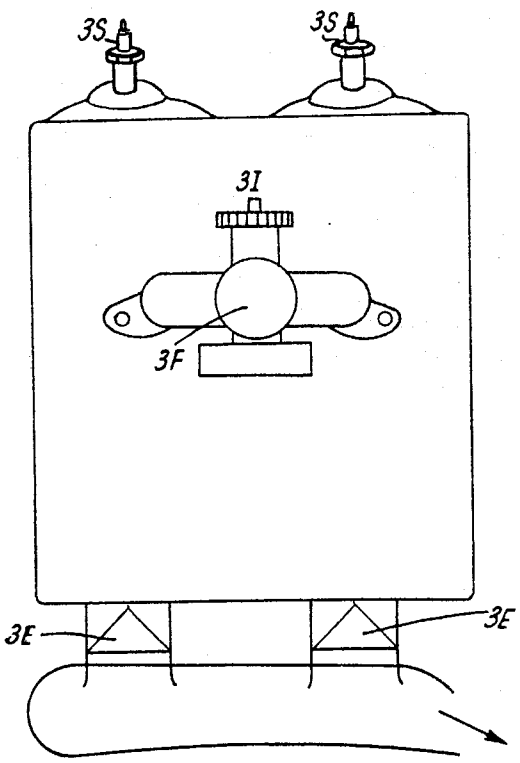
Figure 3A:
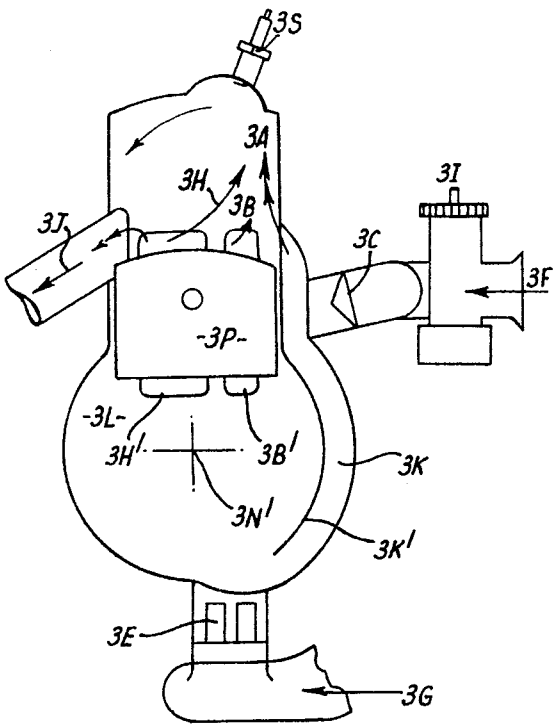

FIG. 3*a* is a side elevational view in section of a twin cylinder two-stroke internal combustion engine;

FIG. 3*b* is an end elevational view of the engine shown in FIG. 3*a;*

Figure 4A:
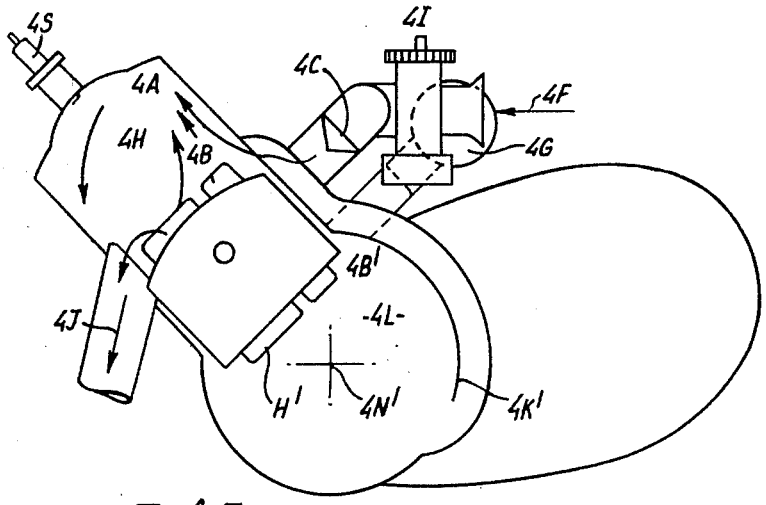
Figure 4B:
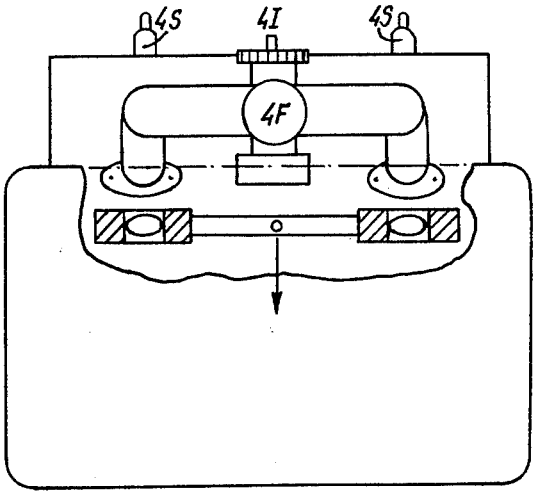

FIG. 4*a* is a side elevational view in section of an alternative form of twin cylinder engine;

FIG. 4*b* is an end elevational view of the engine shown in FIG. 4*a;*

Figure 5B:
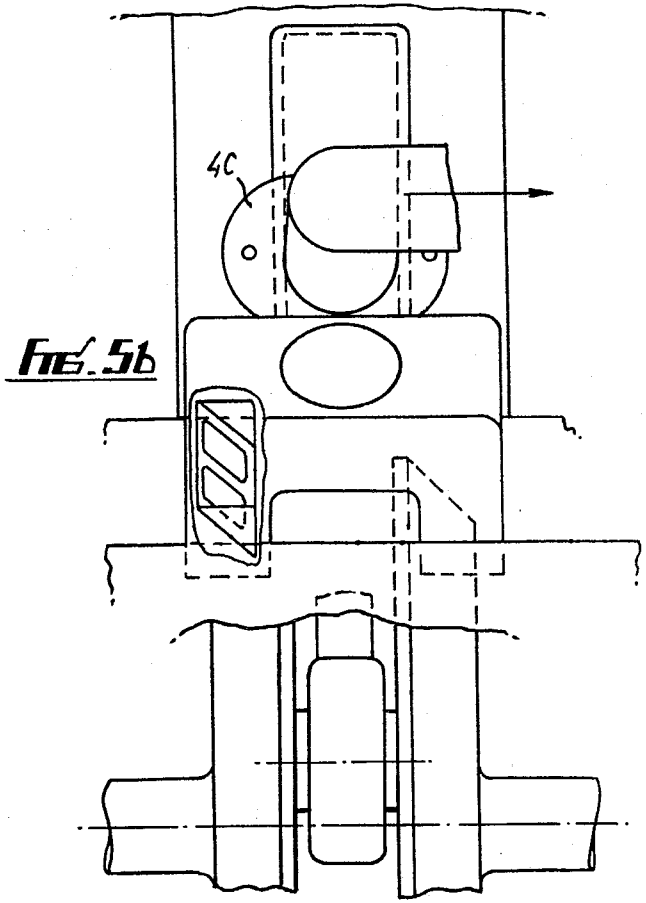
Figure 5A:
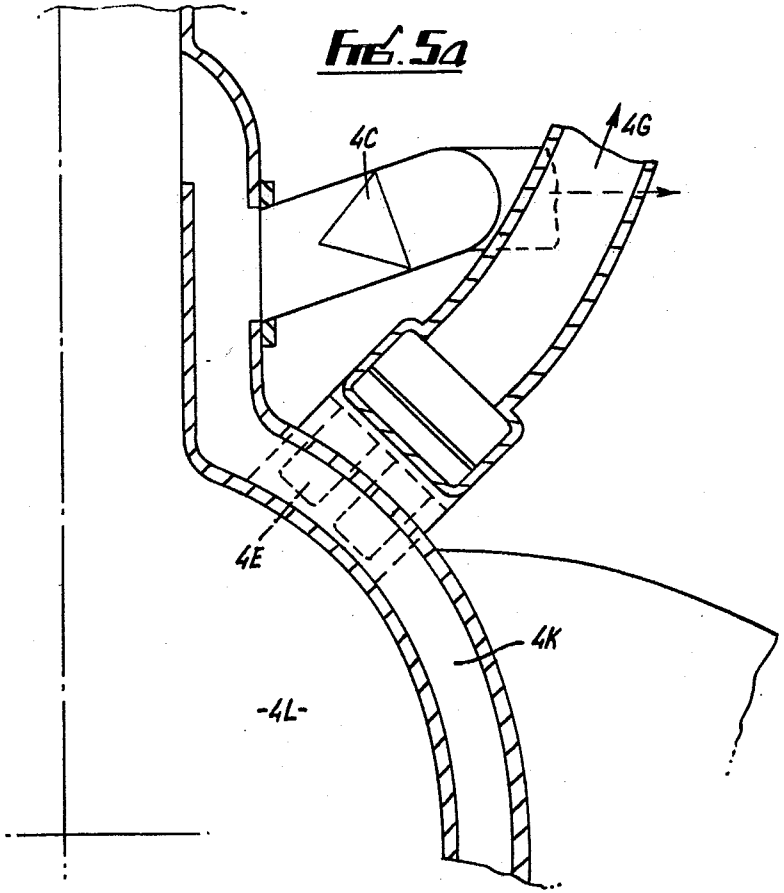

FIG. 5*a* is a more detailed front elevational view of a part of the engine shown in FIGS. 4*a* and 4*b;* and FIG. 5*b* is a partial side elevational view of the form of engine shown in FIGS. 4*a* and 4*b*.

Figure 2:
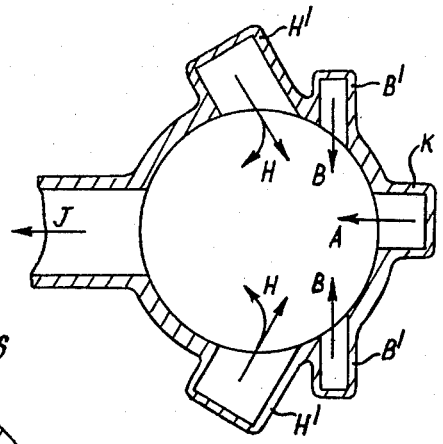
FIG. 2 is a horizontal section through the exhaust port of the engine of FIG. 1.
Figure 1:
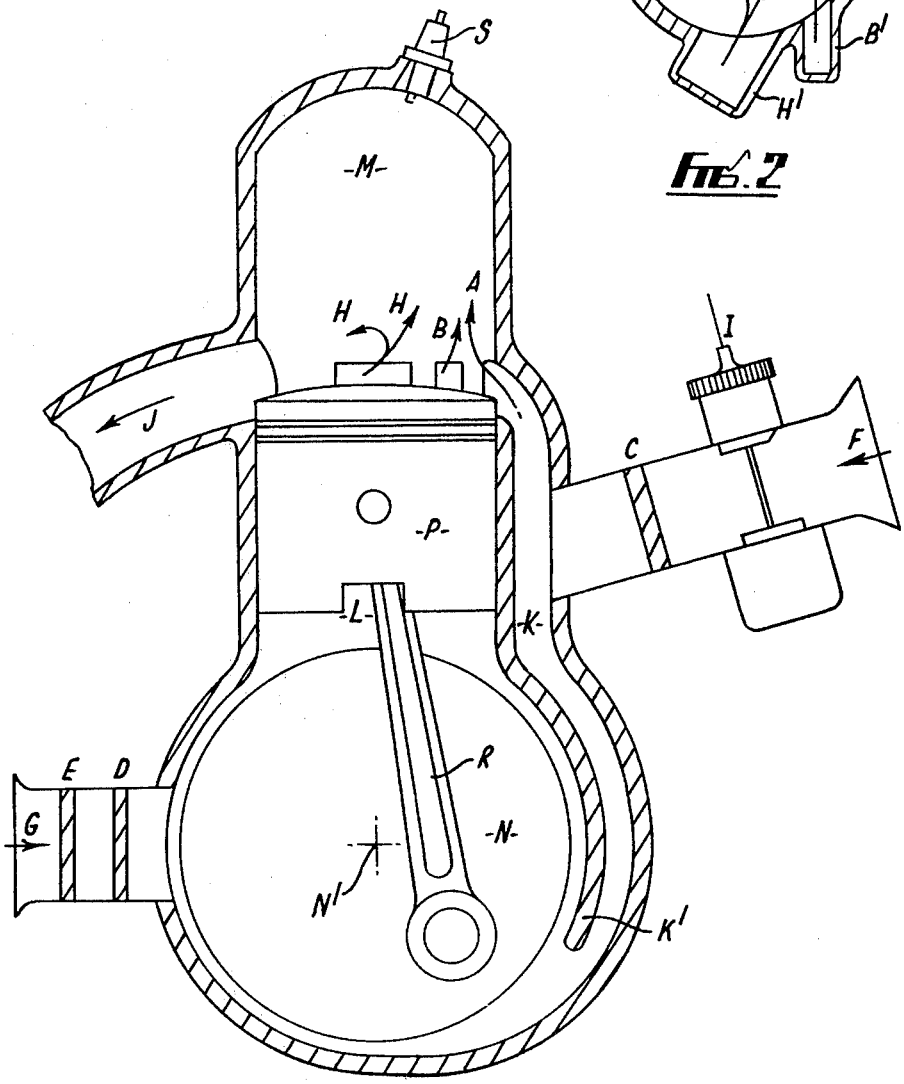
FIG. 1 is a longitudinal section through a single cylinder two-stroke internal combustion engine.

Referring to FIGS. 1 and 2, the engine is of the crankcase compression type in which the piston P pumps fluid from a crankcase chamber L to the combustion chamber or cylinder M, the crankshaft N and connecting rod R being shown diagrammatically. Spark discharge means S are provided in the usual way.

The engine includes a transfer duct K communicating at its lower end with the crankcase chamber L and at its other end with the combustion chamber M at a location diametrically opposite to the exhaust port J. The engine is shaped to provide passages B′, H′ which provide communication between the crankcase chamber L and the combustion chamber M when the piston P is at the lower region of its reciprocal movement and are nearer the port J than passage K.

It will be observed that the duct K in its lower portion is defined in part by curved wall K′ which extends below the level of the axis N′ of the crankshaft N.

The engine has a first admission port G which communicates directly with the crankcase chamber L. The engine has a second admission port F communicating with the duct K in the upper region of the duct K.

It is proposed that the air for combustion shall be induced into the sealed crankcase chamber L of such an engine by the two apertures F and G, and that the air entering via aperture F shall induce or have inserted into this flow through F all the required fuel quantity for correct or optimum operation of the engine. The air entering through aperture G shall induce or have inserted into such air flow none of the required fuel quantity for correct or optimum operation of the engine. The induction of the streams of fresh charge F and G shall be controlled by valves C and D which can be either of the automatic type such as a read valve or can be controlled by the movement of the piston or the rotation of the crankshaft. The total flow quantity of the fresh charge streams F and G into the engine can be controlled by throttles at I and E. It is expected that up to 30% of the required air will enter through G while the remainder will enter through F.

Some small portion of the fuel entering at F will in practice enter crankcase chamber L but the dimensions, and in particular the length, of duct K is such that a minimum or very small amount of fuel reaches chamber L.

During the scavenge or transfer portion of the engine cycle the fresh air and fuel charge is expelled from the crankcase chamber L by the pumping or compression movement of the piston and this air and fuel charge enters the cylinder M via streams A, B and H respectively through the transfer ducts K, B′, H′, H′ extending from the crankcase chamber L. The stream of fresh charge labelled A emanates from the transfer duct K and contains the major portion of the fuel quantity required for the correct or optimum operation of the engine and as this stream of fresh charge labelled A is at the farthest possible distance from the exhaust port J then it can be expected that very little of this stream A will exit from the cylinder via exhaust port J until the piston seals the exhaust port J.

The other streams of fresh charge B and H containing a minor part, in practice small part, of the fuel required for correct or optimum operation of the engine shall enter the cylinder in such a manner so that the major proportion of these streams will be retained in the cylinder M for the combustion process. In the event that some of these streams B and H be short-circuited into the exhaust port J, then as they consist mostly of air, only a small proportion of the total fuel quantity supplied to the engine will be lost to the exhaust system and will not participate in the combustion process in the engine cylinder M. Should the streams B and H consist of air only then any short-circuiting of these streams B and H into the exhaust system or systems via the exhaust port J will provide oxygen for further beneficial oxidisation of the combustion products from the previous firing cycle, and tend to assist with a reduction in the exhaust emissions of carbon monoxide and unburned hydrocarbons.

Ideally all the fuel will be in stream A. In the case where streams B and H include some fuel, the supply of fuel and air to chamber M is stratified, that is in at least two streams.

The supply of fuel to port F can be via a carburettor.

There could be a plurality of exhaust ports J generally opposite to duct K.

There could be a plurality of ducts K, each with its own fuel inlet port, the ducts K being generally opposite to the exhaust port or ports.

There could be a plurality of admission ports G. The port or ports G can be in other locations.

Lubricant could conveniently be admitted through port or ports G and as the lubricant is usually a hydrocarbon some of it would form part of streams B and H and be burnt during combustion. From this point of view the lubricant might be regarded as fuel.

In the preferred arrangement only air is admitted at port or ports G but it is contemplated that a small amount of fuel could be admitted through port or ports G. However, a stream F contains a higher proportion of fuel to air than does stream G. In practice stream A would include most of the fuel.

The foregoing discussion has been applied to a single-cylinder engine but is equally applicable to an engine unit of the two-stroke cycle consisting of two or more cylinders in any mechanical arrangement of those two or more cylinders. Two forms of such a multicylinder engine (in this case two cylinder) are shown in FIGS. 3*a* and 3*b*, 4*a* and 4*b* and 5*a* and 5*b*. Parts of the embodiments of these FIGS., equivalent to those of the embodiment of FIGS. 1 and 2 have been given the same letter references as FIGS. 1 and 2 preceded by the numeral 3 or 4 as appropriate.

Referring to FIGS. 3*a* and 3*b*, a two cylinder two-stroke internal combustion engine is shown, in which each cylinder is generally of the same construction as the single cylinder of the engine of FIGS. 1 and 2. In the two cylinder engine, however, the admission port 3G splits into two branches leading to the bases of respective crankcase chamber 3L via respective throttles 3E. The admission port 3F also splits into two branches leading into respective transfer ducts 3K. A single throttle 31 is provided in the port but a reed valve 3C is provided in each branch. The throttles 3E are cable operated and the admission port 3G leads to an air box.

Whereas FIGS. 3*a* and 3*b* illustrate a two cylinder embodiment of the invention suitable for use in an outboard marine engine, FIGS. 4*a* and 4*b* show a similar two cylinder embodiment for use on a motor cycle. Referring to FIGS. 4*a* and 4*b*, this engine is very similar to that of FIGS. 3*a* and 3*b*, but is differently oriented and has a similar method of introducing air to the engine.

The described engines are of the loop scavenging kind but the invention is also applicable to engines of the cross-scavenging kind which also have duct or ducts K.

I claim:

1. A stratified-charge two-stroke internal combustion engine comprising: a combustion chamber having an exhaust port, a first inlet port, and a second inlet port positioned closer to said exhaust port than said first inlet port; a piston reciprocable in said combustion chamber; a crankcase chamber; a first duct extending from the first inlet port in the combustion chamber to a position in the crankcase chamber remote from said combustion chamber; a first admission port connecting with said first duct at a position intermediate its ends for introducing a fuel-air mixture into said first duct; a second duct extending between the second inlet port in the combustion chamber and said crankcase chamber; and a second admission port communicating with said crankcase chamber for introducing air into said crankcase chamber, communication between said combustion chamber and said crankcase chamber through said first and said second ducts being controlled by movement of said piston, the arrangement of said first and second second inlet portions being such that air introduced into said combustion chamber through said second duct substantially separates a fuel-air mixture introduced into said combustion chamber through said first duct from gases being exhausted through said exhaust port.

2. A two-stroke internal combustion engine as claimed in claim 1, in which the further admission port leads directly to the crankcase chamber and is operative to admit air to the chamber.

3. A two-stroke internal combustion engine as claimed in claim 2, in which there are at least two further admission ports.

4. A two-stroke internal combustion engine as claimed in claim 1, 2, or 3 in which at least two exhaust ports lead from the combustion chamber.

5. A two-stroke internal combustion engine as claimed in 1, 2, or 3, in which the first mentioned admission port to the duct is operative to admit air and fuel to the duct.

6. A two-stroke internal combustion engine as claimed in claim 1 or 2 including means for admitting lubricant through the further admission port.

7. A two-stroke internal combustion engine as claimed in claim 1, 2, or 3 which is a single cylinder engine.

8. A two-stroke internal combustion engine as claimed in claim 1, 2, or 3, which is a multicylinder engine.

9. A two-stroke internal combustion engine as claimed in claim 1, 2, or 3, further comprising at least two exhaust ports leading from the combustion chamber and means for admitting lubricant through a further admission port, and in which the first mentioned admission port to the duct is operative to admit air and fuel to the duct.

* * * * *